US009211692B2

(12) United States Patent
Graushar et al.

(10) Patent No.: US 9,211,692 B2
(45) Date of Patent: Dec. 15, 2015

(54) IN-LINE SHELL PROCESSING

(75) Inventors: William T. Graushar, Elm Grove, WI (US); John C. Geres, West Allis, WI (US)

(73) Assignee: Quad/Graphics, Inc., Sussex, WI (US)

( * ) Notice: Subject to any disclaimer, the term of this patent is extended or adjusted under 35 U.S.C. 154(b) by 1649 days.

(21) Appl. No.: 12/413,180

(22) Filed: Mar. 27, 2009

(65) Prior Publication Data

US 2010/0244352 A1 Sep. 30, 2010

(51) Int. Cl.
*B41F 13/54* (2006.01)
*B41F 13/56* (2006.01)
*B65H 45/28* (2006.01)

(52) U.S. Cl.
CPC ..... *B41F 13/56* (2013.01); *B65H 45/28* (2013.01)

(58) Field of Classification Search
CPC ..... B41F 13/56; B65H 45/28
USPC ..... 101/226, 227; 270/1.01, 1.02, 52.01, 270/52.02, 52.03, 52.04
See application file for complete search history.

(56) References Cited

U.S. PATENT DOCUMENTS

| | | | |
|---|---|---|---|
| 3,608,888 | A | 9/1971 | McCain et al. |
| 3,796,487 | A | 3/1974 | Voorhees |
| 3,804,005 | A | 4/1974 | Burger et al. |
| 3,819,173 | A | 6/1974 | Anderson et al. |
| 3,899,165 | A | 8/1975 | Abram et al. |
| 3,917,252 | A | 11/1975 | Harder et al. |
| 3,966,186 | A | 6/1976 | Helm |
| 4,022,455 | A | 5/1977 | Newsome et al. |
| 4,065,117 | A | 12/1977 | Thorsheim |
| 4,121,818 | A | 10/1978 | Riley et al. |
| 4,149,711 | A | 4/1979 | Jackson |
| 4,273,319 | A | 6/1981 | Stocker |
| 4,388,994 | A | 6/1983 | Suda et al. |
| 4,502,676 | A | 3/1985 | Stocker |
| 4,576,370 | A | 3/1986 | Jackson |
| 4,580,770 | A | 4/1986 | Warden et al. |
| 4,582,312 | A | 4/1986 | Abrams et al. |
| RE32,690 | E | 6/1988 | Wong |
| 4,789,147 | A | 12/1988 | Berger et al. |
| 4,799,661 | A | 1/1989 | Nail |
| 4,800,504 | A | 1/1989 | Durst, Jr. et al. |
| 4,800,505 | A | 1/1989 | Axelrod et al. |

(Continued)

FOREIGN PATENT DOCUMENTS

| | | |
|---|---|---|
| JP | 2000219421 | 8/2000 |

OTHER PUBLICATIONS

Delphax CR Series Brochure, Delphax Technologies, Inc., Bloomington, MN, publication date unknown. Acquired by inventor William T. Graushar in Nov. 2007.

(Continued)

*Primary Examiner* — Jennifer Simmons
(74) *Attorney, Agent, or Firm* — Michael Best & Friedrich LLP

(57) ABSTRACT

A method of printing and assembling a printed product including unrolling a continuous web of paper from a roll on a printing line, printing non-personalized information on the paper on the printing line, printing personalized information on the paper on a finishing line, performing at least one paper conversion step after printing the personalized information to create a personalized signature on the finishing line, and feeding the personalized signature into a pocket on the finishing line.

15 Claims, 5 Drawing Sheets

(56) References Cited

U.S. PATENT DOCUMENTS

| | | | |
|---|---|---|---|
| 4,800,506 | A | 1/1989 | Axelrod et al. |
| 4,835,544 | A | 5/1989 | Winterburn |
| 4,953,841 | A | 9/1990 | Polarek |
| 4,989,852 | A | 2/1991 | Gunther, Jr. |
| 5,013,022 | A | 5/1991 | Graushar |
| 5,033,725 | A | 7/1991 | van Duursen |
| 5,039,077 | A | 8/1991 | Gunther, Jr. |
| 5,067,088 | A | 11/1991 | Schneiderhan |
| 5,080,337 | A | 1/1992 | Mayer et al. |
| 5,100,116 | A | 3/1992 | Graushar |
| 5,114,128 | A | 5/1992 | Harris, Jr. et al. |
| 5,143,362 | A | 9/1992 | Doane et al. |
| 5,177,687 | A | 1/1993 | Baggarly et al. |
| 5,186,443 | A | 2/1993 | Manley et al. |
| 5,276,628 | A | 1/1994 | Schneiderhan |
| 5,287,976 | A | 2/1994 | Mayer et al. |
| 5,317,654 | A | 5/1994 | Perry et al. |
| 5,377,120 | A | 12/1994 | Humes et al. |
| 5,419,541 | A | 5/1995 | Stevens |
| 5,458,323 | A | 10/1995 | Magee et al. |
| 5,510,997 | A | 4/1996 | Hines et al. |
| 5,547,175 | A | 8/1996 | Graushar et al. |
| 5,547,178 | A | 8/1996 | Costello |
| 5,655,759 | A | 8/1997 | Perkins et al. |
| 5,707,055 | A | 1/1998 | DeJoseph et al. |
| 5,745,590 | A | 4/1998 | Pollard |
| 5,798,930 | A | 8/1998 | van Oosten |
| 5,818,724 | A | 10/1998 | Brewster, Jr. et al. |
| 5,838,574 | A | 11/1998 | Olson et al. |
| 5,918,879 | A | 7/1999 | Steinhilber |
| 5,988,620 | A | 11/1999 | Graushar |
| 6,012,890 | A | 1/2000 | Celorio Garrido |
| 6,167,326 | A | 12/2000 | Graushar et al. |
| 6,192,295 | B1 | 2/2001 | Gunther |
| 6,206,358 | B1 | 3/2001 | Yamaguchi et al. |
| 6,240,334 | B1 | 5/2001 | Duke et al. |
| 6,257,566 | B1 | 7/2001 | Dooley |
| 6,347,260 | B1 | 2/2002 | Graushar et al. |
| 6,519,503 | B2 | 2/2003 | Paterson et al. |
| 6,670,569 | B2 | 12/2003 | Smith et al. |
| 6,767,011 | B2 | 7/2004 | Kavanagh |
| 6,827,012 | B1 * | 12/2004 | Palmatier ..... 101/225 |
| 6,974,034 | B2 | 12/2005 | Smith et al. |
| 7,096,088 | B2 | 8/2006 | Graushar et al. |
| 7,198,260 | B2 | 4/2007 | Huber et al. |
| 2002/0100253 | A1 | 8/2002 | Graushar et al. |
| 2003/0062293 | A1 | 4/2003 | Graushar et al. |
| 2003/0112479 | A1 | 6/2003 | Huber et al. |
| 2003/0195788 | A1 | 10/2003 | Loeb et al. |
| 2004/0173958 | A1 | 9/2004 | Graushar |
| 2006/0097439 | A1 | 5/2006 | Langenegger |
| 2008/0035534 | A1 | 2/2008 | Graushar |
| 2008/0093788 | A1 | 4/2008 | Graushar |
| 2010/0059917 | A1 | 3/2010 | Graushar |
| 2010/0296127 | A1 | 11/2010 | Barndt et al. |

OTHER PUBLICATIONS

Muller Martini Corp., "SigmaLine—The advanced solution for digital book manufacturing" press release, Apr. 3, 2008, 4 pages.

MBO General Catalog, May 2008, MBO Maschinebau Oppenweiler Binder GmbH & Co. KG, Stuttgart, Germany. pp. 175-185, and 194.

Müller Martini, SigmaLine Digital Book Production brochure, May 2008, 18 pages.

U.S. Patent Office action dated Dec. 1, 2014 in related U.S. Appl. No. 14/021,557.

U.S. Patent Office action dated Apr. 9, 2015 in related U.S. Appl. No. 14/021,557.

* cited by examiner

IN-LINE SHELL PROCESSING

BACKGROUND

In the print industry, personalization of printed products is known, however, such personalization has been limited in one or more ways. One type of personalization is to print personalized information on generic pages in an offline process, after which the personalized pages can be stacked and delivered to a feeder of a finishing line. The feeder may then deliver the personalized pages to the pocket of the finishing line, where they can then be subsequently assembled. In this system, complicated verification processes are generally required to ensure that specific personalized pages are coordinated into the proper publications.

Another personalization process includes printing personalized information onto individual pages as they are delivered to the pocket on the binding line. This is commonly referred to as a print-on-demand process. Although print-on-demand may eliminate the need for complicated verification controls by repositioning the personalization onto the binding line, the process remains limited to personalization on a page-by-page basis, which is generally unable to match the production speeds of the binding line.

In yet another personalization process, pages of a book are ink-jetted on a finishing line after they are assembled to personalize the books. When personalization of interior pages are desired, traditional processes only permit personalization of less than all of the available print space due to printing and space constraints; they do not permit personalization of any given portion of an entire sheet.

SUMMARY

In one embodiment, a method of printing and assembling a printed product is provided including unrolling a continuous web of paper from a roll on a printing line, printing non-personalized information on the paper on the printing line, printing personalized information on the paper on a finishing line, performing at least one paper conversion step after printing the personalized information to create a personalized signature on the finishing line, and feeding the personalized signature to the finishing line. The personalized signature can be fed into a pocket on the finishing line.

In another embodiment, a method of printing and assembling a printed product is provided including providing a continuous web of paper to a finishing line, a portion of the web being pre-printed with non-personalized information, providing the continuous web of paper to a printer, printing personalized information on the web of paper with the printer associated with the finishing line, performing at least one paper conversion step to the web of paper on the finishing line after printing the personalized information to create a personalized signature, and feeding the personalized signature to the finishing line. The personalized signature can be fed to a pocket associated with the finishing line.

In yet another embodiment, a method of printing and assembling a printed product is provided including providing a plurality of sheets on a binding line, each of the plurality of sheets having non-personalized information printed thereon, feeding the plurality of sheets to a printer on the binding line, printing personalized information on the plurality of sheets on the binding line, performing at least one paper conversion step to the plurality of sheets after printing the personalized information to create a plurality of personalized signatures on the binding line, and feeding each of the plurality of personalized signatures to the binding line. Each of the plurality of personalized signatures can be fed into a pocket on the binding line.

In yet another embodiment, a method of printing and assembling printed product is provided including providing a pre-printed substrate to a finishing line, personalizing at least apportion of the pre-printed substrate, performing at least one paper conversion step to the pre-printed substrate on the finishing line to create a signature, and providing the signature to the finishing line. The signature can be provided to a pocket associated with the finishing line.

Each of the above-described methods can be done in an in-line process.

Other aspects of the invention will become apparent by consideration of the detailed description and accompanying drawings.

DETAILED DESCRIPTION

Before any embodiments are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
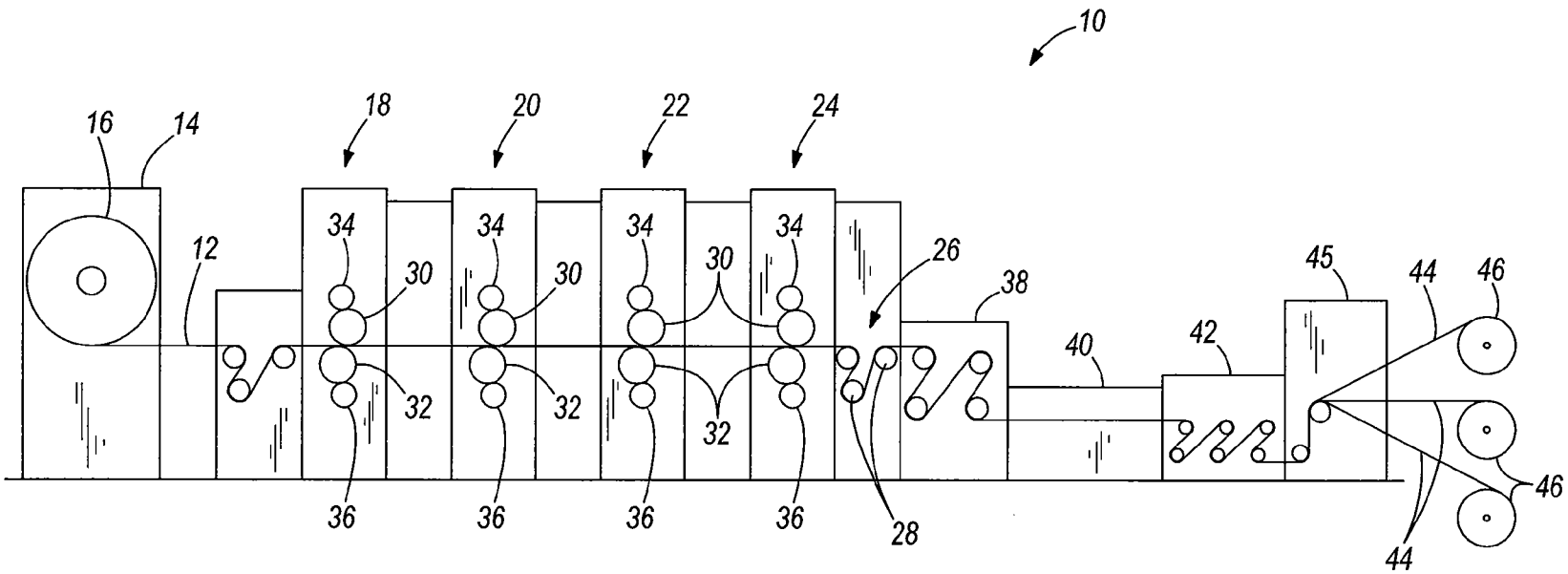
FIG. 1 is a schematic of a printing line according to some embodiments of the present invention.

Referring to FIG. 1, a printing press 10 for printing a number of repetitive images upon a substrate (e.g., paper), in the form of a web 12 for example, is illustrated. The printing press 10 is utilized to print generally static (generic) information on the web 12. The printing press 10 illustrates a web offset press that includes a reel stand 14 that supports a reel 16 of the web 12. It should be noted that the invention is equally applicable to sheet fed presses and other non-offset presses such as gravure presses and newspaper presses for example.

The printing press 10 includes printing units 18, 20, 22, and 24, each of which prints in a different color ink. In the illustrated printing press 10, the first printing unit 18 encountered by the web 12 prints with black ink and the other printing units 20, 22 and 24 print with other colors. For example, the printing unit 20 may print in magenta ink, the printing unit 22 may print in cyan ink, and the printing unit 24 may print in yellow ink. It should be understood, however, that the invention is capable of being carried out with printing units that print in different colors, and/or with fewer or additional printing units. It should also be understood that while the web 12 itself is generally monochromatic, the color of the web 12 can be any color, including, but not limited to, white, brown, off-white, yellow, etc. Moreover, sheets may be used in place of a web.

The printing press 10 includes a drive system 26, including drive rollers 28, that moves the web 12 from the reel 16 through each of the printing units 18, 20, 22, and 24. The images printed by each of the printing units 18, 20, 22 and 24 overlap to create composite multi-color images on the traveling web 12.

Each printing unit 18, 20, 22, and 24 includes a pair of parallel rotatable blanket cylinders 30 and 32 that nip the web 12. Each printing unit 18, 20, 22, and 24 further includes a plate cylinder 34 which has a printing plate thereon, and which applies an ink image to the blanket cylinder 30. Optionally, if it is desired to print both sides of the web 12, each printing unit 18, 20, 22, and 24 will further include a plate cylinder 36 which has a printing plate thereon, and which applies an ink image to the blanket cylinder 32. The blanket cylinders 30 and 32 transfer the ink images, received from the plate cylinders 34 and 36, to the web 12. The printing units 18, 20, 22, 24 can print any place on the web 12 where an image is desired, but also can leave unprinted spaces on either or both sides of the web 12 to permit personalized information to be added to the web 12 at a later time.

After exiting the printing stations 18, 20, 22, and 24, the web 12 is guided through various processing units as desired, such as a dryer 38, a chill stand 40, and a coating machine 42. The web 12 can then be cut into ribbons 44 by cutter 45, if desired, and re-rolled to form a plurality of reels 46. In the illustrated embodiment, the web 12 is cut into three ribbons 44, but the web 12 could be cut into more or fewer ribbons 44, depending upon the given parameters and variables of each individual printing operation. In another embodiment, the web 12 is re-rolled to form a single reel 46 without cutting the web 12 into ribbons 44. As described below, the term pre-printed shell 48 is used to describe either the re-rolled web 12 or the re-rolled ribbons 44, both of which have generally static (or generic) information printed thereon.

Figure 2:
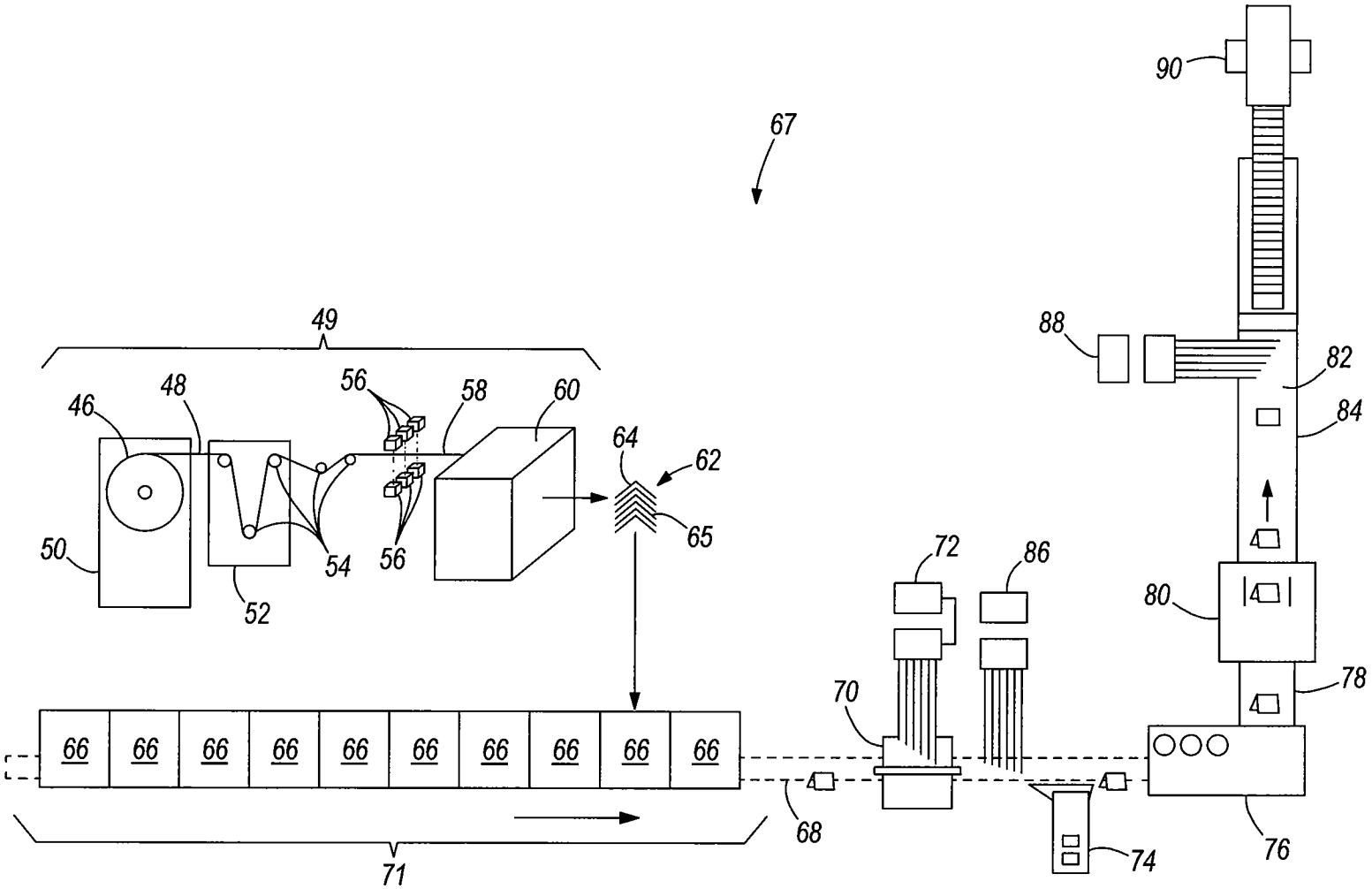
FIG. 2 is a schematic of a finishing line according to some embodiments of the present invention.

A personalization line 49 is shown in FIG. 2. One of the plurality of reels 46 is supported on a reel stand 50 and the pre-printed shell 48 is unrolled from the reel 46 and can be directed through a buffer 52. The buffer 52 may include a plurality of stabilizers 54 to adjust the tension of the pre-printed shell 48, as well as the timing of unrolling the reel 46. In the illustrated embodiment, a plurality of stabilizers 54 is also positioned outside the buffer 52. The buffer 52, although only shown in FIG. 2, can be positioned anywhere along the printing or binding lines shown in FIGS. 1 and 2, or multiple buffers 52 can be provided along the printing or binding lines of FIGS. 1 and 2.

The reels 46 can be stored between being re-rolled in FIG. 1 and being unrolled in FIG. 2. In another embodiment, the reels 46 are transferred directly after being re-rolled in FIG. 1 to being un-rolled in FIG. 2, without a time delay in between. In still another embodiment, the pre-printed shell 48 can be transferred directly from the coating machine 42 to the buffer 52, without being re-rolled and un-rolled.

The pre-printed shell 48 is then directed through at least one printer 56 that can print on the unprinted portions of the pre-printed shell 48 to add personalized information and to thereby form a printed web 58 that includes both generic and personalized information. The personalized information can be printed anywhere on the pre-printed shell 48. In the illustrated embodiment, three printers 56 are included above the pre-printed shell 48 and three printers 56 are included below the pre-printed shell 48. The quantity of printers 56 at least partially depends upon the requirements of the individual printing project. It may be desirable to provide one printer 56 for each page width of the pre-printed shell 48.

For example, if the pre-printed web is of a 2×3 arrangement (2 pages by 3 pages), three printers 56 along the width may be desirable since each printer 56 will be dedicated to printing on one page width of the pre-printed shell 48. Other arrangements and configurations of printers 56 and various widths of the pre-printed shell 48 are possible (for example using multiple print units to "stitch" an image together), and these numbers are given by way of example only. The printers 56 are illustrated on the top and the bottom of the pre-printed shell 48. However, it is not necessary to position printers 56 on both the top and the bottom of the pre-printed shell 48. In some embodiments, a flipping plow may be used to flip or rotate the paper to print on the bottom of the pre-printed shell 48 from above or from a side. A plow can also be utilized to pre-fold the pre-printed shell 48. The printers 56 can be ink-jet, laser or any other types of printers. In one embodiment, the printers 56 positioned below the pre-printed shell 48 are laser printers.

In other embodiments, a press may be placed on the front end of the personalization line 49. The press may print static information onto a web or sheets that can then be personalized as described. Alternatively, the press may be a variable printing press that can print both static and personalized information which can then be provided to the personalization line 49 as described. Non-limiting examples of such variable presses may include digital ink-jet or toner based presses.

The printed web 58 includes a plurality of sheets 69 (see FIG. 5) that repeat along the continuous length of the printed web 58. The printed web 58 is then fed into a cutter/folder 60 that performs at least one conversion step to the printed web 58. The cutter/folder 60 can convert the printed web 58 by cutting the printed web 58 into ribbons, cutting the printed web 58 to length, or both. The cutter/folder 60 can convert the printed web 58 by folding the printed web 58 (such as bi-folding, tri-folding or z-folding), before or after cutting, or instead of cutting the printed web 58. The cutter/folder can also partially cut the printed web 58, such as cutting perforations to enable a user to tear out a section, or cut out a window in a portion of the printed web 58. A converted web 62 is formed by performing at least one paper conversion step. Performing at least one paper conversion step after the web has been fully printed and just prior to assembling a book from the printed web 58 provides the advantage of maintaining the web 58 as one piece, even after the web 58 is fully printed on, so that the various pages can be kept together without complicated tracking, as was required in the prior art. Further, printing anywhere on the surface area of the web is possible. In one embodiment, the pre-printed shell 48 is fed into the cutter/folder prior to being fed through the printers 56.

Figure 7:
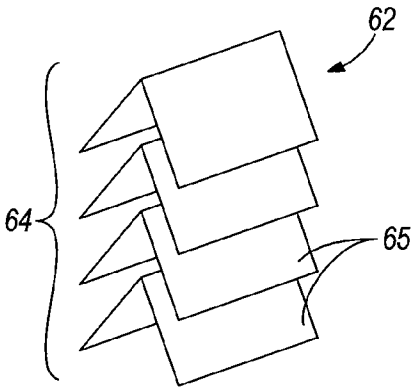
FIG. 7 is a perspective view of a stack of sheets that forms a signature according to some embodiments of the present invention.
Figure 6:
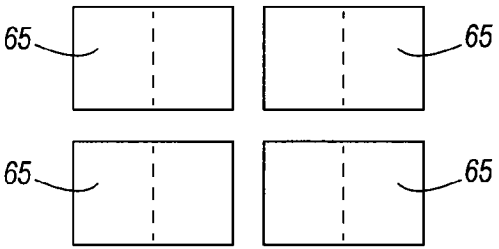
FIG. 6 is a top view of the sheet cut into individual pages according to some embodiments of the present invention.
Figure 5:
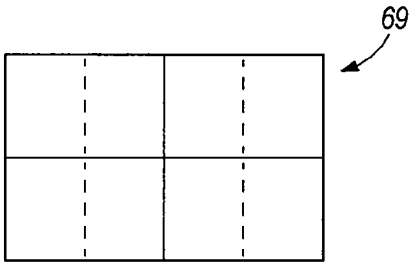
FIG. 5 is a top view of a sheet according to some embodiments of the present invention.

After at least one conversion step, the converted web can be stacked into a stack 62 that includes a plurality of pages 65 that collectively form one signature 64. FIGS. 5-7 more clearly illustrate that a sheet 69 is cut into individual pages 65 that are folded and stacked to form a signature 64. The signature 64 is fed directly to an individual pocket feeder 66 on a binding line 71. The binding line 71 forms a part of the finishing line 67 illustrated in FIG. 2. A plurality of the pockets 66 may operate to selectively feed associated signatures 64 (i.e., a portion of a book) to a conveyor line 68 to assemble different versions of a single publication. The conveyor line 68 can be a gathering chain onto which a plurality of signatures 64 is stacked to assemble a book. A stream of books including different personalized book versions may be produced in a prearranged order, for example, in zip code order, according to a first mailing list for that stream of books.

In some embodiments, personalized signatures can be fed into one or more of the pocket feeders 66. For example, the illustrated personalization line 49 may provide personalized signatures to one or more of the pocket feeders 66 on the binding line 71. Alternately, a dedicated personalization line can be provided for each respective pocket feeder 66 that is to receive personalized signatures. Additional personalization lines may have at least one printer 56 and/or one cutter/folder 60. In embodiments in which less than all of the pockets 66 receive personalized signatures, other pockets 66 can receive non-personalized signatures. The pockets 66 that receive non-personalized signatures can each have a cutter/folder 60 associated therewith, or can simply be provided a stack of non-personalized signatures that are printed and cut on the printing line 10.

The signature 64 can be fed directly into the pocket 66 at production speed. Production speed for a binder is between about 6,000 and about 20,000 books per hour whereas production speed for a stitcher is between about 10,000 to about 30,000 books per hour. The signature 64 (including those with personalized information) may be fed into any of the pocket feeders 66 at production speed. The present invention allows personalized books to be created at production speed in the binding line 71.

As shown in FIG. 2, the stream of books is fed from the binding line 71 to a saddle print stand 70. The saddle print stand can 70 include at least one printer 72, such as an ink jet printer, that prints enhancements to the title of the publication and/or other information on one or more printed products.

As the books are conveyed, a plow device 84 may be operable to open each book so that a printer 86, such as an ink jet printer, can print on an inside page of the book. For example, personalization such as the name, address and customer number or other relevant information corresponding to the intended recipient can be printed on the order form of a book. Optionally, a cardfeeder 74 selectively inserts various cards into each book. Each book is stitched and then trimmed at respective stations 76 and 78. Although a saddle stitcher finishing line 67 is illustrated, a perfect bind finishing line can be utilized in another embodiment.

After trimming, an inspection system 80 may be used to inspect each book (for example, by measuring its squareness) to detect unacceptable books. An unacceptable book can be rejected and a generic book is fed at location 82 to fill the slot of any previously rejected book, so as to maintain the zip code order of the demographically produced books.

In alternative embodiments, when an unacceptable book has been rejected, the system can identify that book and control the re-manufacture of the signatures used to make the rejected book by the methods described herein (e.g., print, optionally personalize, convert and deliver to the line). In this embodiment, the control system can identify which bundle of books should have contained the rejected book and control the diversion of that bundle of books from the bundles containing the correct number and order of books using a bundle diverter. The control system may also control and monitor which book has been rejected and where the regenerated book is in the manufacturing process and line. Once the regenerated signatures are used to re-build the rejected book, the control system can control the diversion of the regenerated book so that it can then be combined with the diverted bundle in desired order, for example in pre-sort order for mailing. The bundle can then be recombined with the other bundles in desired order.

Each book is next directed to a mailtable 84. Here, additional personalization and/or customization may occur. For example, each book then can be directed to an additional ink jet printer 88 which can provide additional personalization on an outside page of the book. For example, the name and/or address of the intended recipient can be printed on the outside of the book. As mentioned, the books may be produced in a desired order, such as zip code order.

Figure 3:
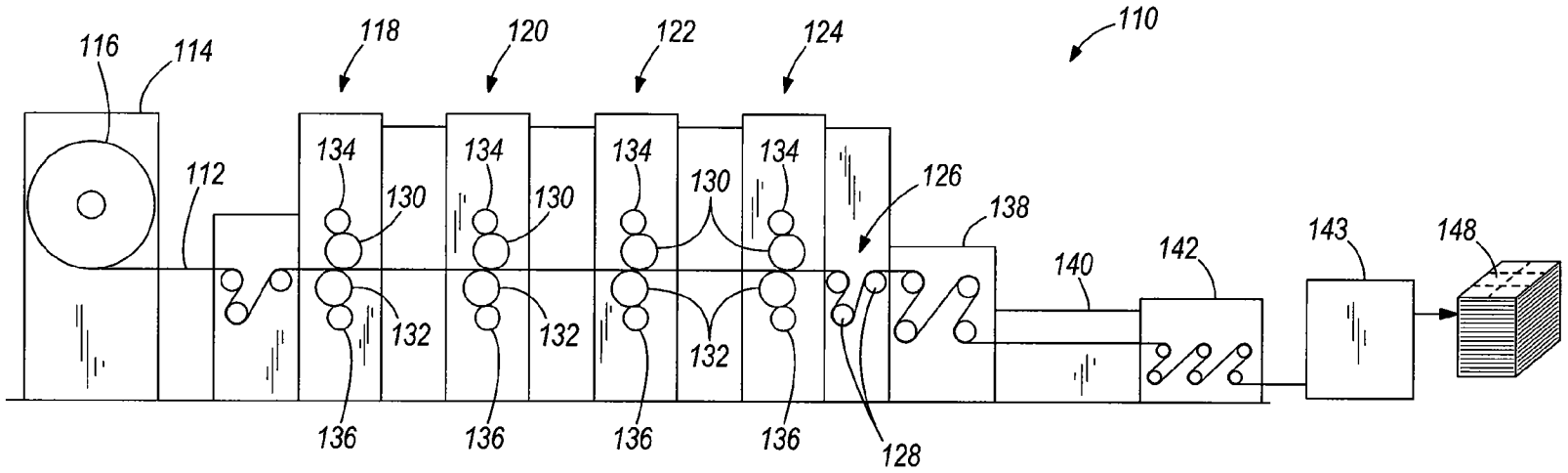
FIG. 3 is a schematic of a printing line according to some embodiments of the present invention.
Figure 4:
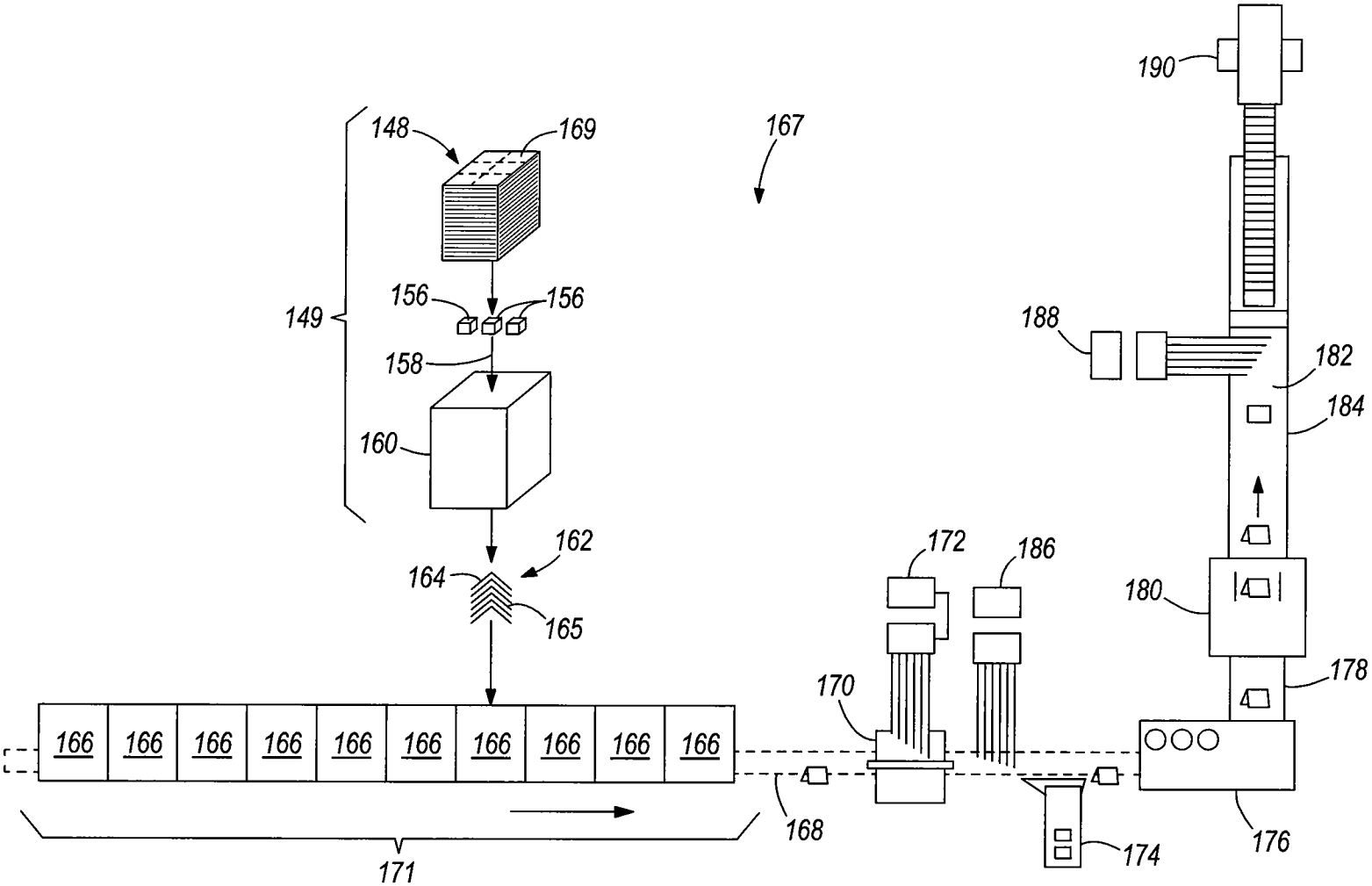
FIG. 4 is a schematic of a finishing line according to some embodiments of the present invention.

FIGS. 3 and 4 illustrate another embodiment of a printing press 110 and a finishing line 167 according to the present invention. This embodiment employs much of the same structure and has many of the same properties as the embodiments of the printing press 10 and finishing line 67 described above in connection with FIGS. 1 and 2. Accordingly, the following description focuses primarily upon structure and features that are different than the embodiments described above in connection with FIGS. 1 and 2. Reference should be made to the description above in connection with FIGS. 1 and 2 for additional information regarding the structure and features, and possible alternatives to the structure and features of the printing press 110 and finishing line 167 illustrated in FIGS. 3 and 4 and described below. Features and elements in the embodiment of FIGS. 3 and 4 corresponding to features and elements in the embodiments described above in connection with of FIGS. 1 and 2 are numbered in the 100 series of reference numbers.

After exiting a dryer 138, a chill stand 140, and a coating machine 142, the web 112 is sent through a cutter/stacker 143 that converts the web 112 into a pre-printed shell shown as pre-printed stack 148. Each sheet 169 in the pre-printed stack 148 includes multiple pages 165, as shown in FIG. 5.

The pre-printed stack 148 can be stored temporarily, or moved directly to a binding line, such as the binding line 171 illustrated in FIG. 4, which includes a personalization line 149. The pre-printed stack 148 is then directed through one or more printers 156 that can print on the unprinted portions of the pre-printed stack 148 to add personalized information and to thereby form a printed stack 158. The personalized information can be printed anywhere on the pre-printed stack 148. In the illustrated embodiment, three printers 156 are included above the pre-printed stack 148. The quantity of printers 156 at least partially depends upon the requirements of the individual printing project. It may be desirable to provide one printer 156 for each page width of the pre-printed stack 148. For example, if the pre-printed web is of a 2×3 arrangement (2 pages by 3 pages), three printers 156 along the width may be most desirable, since each printer 156 will be dedicated to printing on one page width of the pre-printed stack 148. Other arrangements and configurations of printers 156 and various widths of the pre-printed stack 148 are possible, and these numbers are given by way of example only. The printers 156 are illustrated on the top of the pre-printed stack 148. However, printers 156 can be positioned the bottom of the pre-printed stack 148 or on both the top and the bottom of the pre-printed stack 148. In some embodiments, a flipping plow may be used to flip or rotate the paper to print on the bottom of the pre-printed stack 148 from above or from a side. The printers 156 can be ink-jet, laser or any other known printer.

The printed stack 158 is then fed into a cutter/folder 160 that performs at least one conversion step to the printed stack 158. The cutter/folder 160 can convert the printed stack 158 by cutting the printed stack 158 to width, cutting the printed stack 158 to length, or both. The cutter/folder 160 can convert the printed stack 158 by folding the printed stack 158 (such as bi-folding, tri-folding or z-folding), before or after cutting, or instead of cutting the printed stack 158. The cutter/folder can also partially cut, such as cutting perforations to enable a user to tear out a section, or cut out a window in a portion of the printed stack 158. The converted paper is formed into a stack 162 by performing at least one paper conversion step. FIGS. 5-7 more clearly illustrate an example that shows one sheet 69 that includes multiple pages 65 (a 2×2 arrangement that includes four pages 65 is shown in the illustrated example). The pages 65 are cut to length and to width and then folded. The pages 65 are stacked to form a stack 62 that defines one signature 64.

After at least one conversion step, the signature 164 is fed directly to an individual pocket feeder 166 in the binding line 171. A plurality of the pocket feeders 166 operate to selectively feed associated signatures (i.e., a portion of a book) from the signature 164 to a conveyor line 168 to assemble different demographic versions of a single publication. A stream of books including different personalized book versions is produced in a prearranged order, for example, in zip code order, according to a first mailing list for that publication. As discussed above, some or all of the pocket feeders 166 can receive personalized signatures 164 from either personalization lines dedicated to each pocket feeder 166 or a single personalization line for more than one pocket feeder 166.

The signature 164 can be fed directly into the pocket feeder 166 at production speed. As discussed above, production speed for a binder is between about 6,000 and about 20,000 books per hour whereas production speed for a stitcher is between about 10,000 to about 30,000 books per hour. The signature 164 includes personalized data that are fed into any of the pocket feeders 166 in line at production speed, the present invention allows personalized books to be created at production speed in the binding line 171.

The remainder of finishing line 167 operates in a similar manner to the finishing line 67 shown in FIG. 2.

Although two specific embodiments have been described, other variations and configurations can be included without departing from the scope of the present invention. Various features and advantages of the invention are set forth in the following claims.

What is claimed is:

1. A method of printing and assembling a printed product, the method comprising:

unrolling a continuous web of paper from a roll on a printing line;

printing non-personalized information on the paper on the printing line;

printing personalized information on the paper on a finishing line;

performing at least one paper conversion step after printing the personalized information to create a personalized signature on the finishing line; and feeding the personalized signature into a pocket on the finishing line.

2. The method of claim 1, further comprising performing at least one paper conversion step before printing the personalized information on the paper.

3. The method of claim 2, wherein performing at least one paper conversion before printing personalized information on the paper comprises at least one of cutting the paper into ribbons and cutting the paper to length on the printing line.

4. The method of claim 1, further comprising maintaining the finishing line at an operating speed while the personalized signature is fed into the pocket.

5. The method of claim 1, further comprising re-rolling the paper on the printing line after printing non-personalized information on the paper, and unrolling the pre-printed paper on the finishing line prior to printing personalized information on the paper.

6. The method of claim 1, wherein performing at least one paper conversion after printing the personalized information comprises at least one of cutting the paper into ribbons, cutting the paper to length, and folding the paper.

7. The method of claim 1, further comprising combining the personalized signature with other signatures on the finishing line to form a book.

8. The method of claim 7, further comprising inspecting at least one parameter of the book to detect whether it is acceptable or unacceptable.

9. The method of claim 8, further comprising rejecting the book if it is determined to be unacceptable, and remanufacturing the rejected book including a remanufactured personalized signature by unrolling a continuous web of paper from a roll on the printing line, printing non-personalized information on the paper on the printing line, printing personalized information on the paper on the finishing line, performing at least one paper conversion step after printing the personalized information to create a remanufactured personalized signature on the finishing line, feeding the remanufactured personalized signature into a pocket on the finishing line, and combining the remanufactured personalized signature with other signatures on the finishing line to form a remanufactured book.

10. A method of printing and assembling a printed product, the method comprising:

providing a continuous web of paper to a finishing line, a portion of the web being pre-printed with non-personalized information;

providing the continuous web of paper to a printer;

printing personalized information on the web of paper with the printer associated with the finishing line;

performing at least one paper conversion step to the web of paper on the finishing line after to create a personalized signature; and providing the personalized signature to a pocket associated with the finishing line.

11. The method of claim 10, further comprising maintaining the finishing line at an in-line production speed while the converted paper is fed to the pocket on the finishing line.

12. The method of claim 10, further comprising stacking the converted paper to form a signature that includes a plurality of pages.

13. The method of claim 12, further comprising feeding one signature at a time to the pocket.

14. The method of claim 10, wherein performing at least one paper conversion step includes at least one of cutting the paper and folding the paper.

15. The method of claim 10, further comprising combining the personalized signature with other signatures on the finishing line.

* * * * *